US009004336B2

(12) United States Patent
Sato et al.

(10) Patent No.: US 9,004,336 B2
(45) Date of Patent: Apr. 14, 2015

(54) SHEET CONVEYANCE APPARATUS AND RECORDING APPARATUS

(75) Inventors: Ryosuke Sato, Kawasaki (JP); Kenji Shigeno, Yokohama (JP); Kengo Nieda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 400 days.

(21) Appl. No.: 13/370,714

(22) Filed: Feb. 10, 2012

(65) Prior Publication Data

US 2012/0204785 A1 Aug. 16, 2012

(30) Foreign Application Priority Data

Feb. 14, 2011 (JP) ..... 2011-028823

(51) Int. Cl.
*B65H 23/032* (2006.01)

(52) U.S. Cl.
CPC .. *B65H 23/0322* (2013.01); *B65H 2301/51214* (2013.01)

(58) Field of Classification Search
CPC ..... B65H 23/0322; B65H 2301/51214
USPC ..... 226/3, 15, 19, 20, 88, 105
See application file for complete search history.

(56) References Cited

U.S. PATENT DOCUMENTS 5,967,394 A * 10/1999 Crowley et al. ..... 226/31

FOREIGN PATENT DOCUMENTS

| | | | |
|---|---|---|---|
| JP | 2004-168071 A | | 6/2004 |
| JP | 2004-323149 A | | 11/2004 |
| JP | 2005170633 A | * | 6/2005 |
| JP | 2006-175818 A | | 7/2006 |

OTHER PUBLICATIONS

Machine Translation of JP 2005-170633 A, Jun. 30, 2005.*

* cited by examiner

*Primary Examiner* — William E Dondero
(74) *Attorney, Agent, or Firm* — Canon U.S.A. Inc., IP Division

(57) ABSTRACT

A sheet conveyance apparatus includes a conveyance roller pair that has a roller with a uniform diameter in a sheet width direction and that is configured to pinch and convey a sheet, and a guide unit that is provided on an upstream side of the conveyance roller pair and that is configured to regulate a position of an edge of the sheet, wherein the conveyance roller pair conveys the sheet in a state in which the sheet is bended by the guide unit so that on a roller side with a uniform diameter in a sheet width direction, the sheet convexly bends.

15 Claims, 14 Drawing Sheets

SHEET CONVEYANCE APPARATUS AND RECORDING APPARATUS

BACKGROUND OF THE INVENTION

1. Field of the Invention

The present invention relates to a sheet conveyance apparatus and a recording apparatus that records an image on a sheet.

2. Description of the Related Art

Japanese Patent Application Laid-Open No. 2004-323149 discusses a paper conveyance apparatus and an image forming apparatus that use a conveyance roller pair that includes at least one split roller in which the roller portion is split. By applying a biasing force on one of the conveyance rollers from the split roller, a compressive force can be uniformly applied without causing the conveyance rollers to go slack. Further, the paper orientation is corrected by a film guide provided on an upstream side that presses the sheet. Consequently, the sheet is conveyed in a flat shape, which prevents the wrinkles that are produced by the sheet bending between the split rollers. The orientation of the entire sheet width is corrected by the film guide before the sheet is fed from the upstream side to the roller pair, whose configuration includes a drive roller and a driven roller that is split from the drive roller.

However, in a sheet conveyance apparatus like that discussed in Japanese Patent Application Laid-Open No. 2004-323149, which presses the sheet with a film, the pressing force of the film on the sheet causes a back tension to act on the conveyance roller pair arranged on a downstream side. Consequently, there is the problem that the actual conveyance distance is shorter than an ideal conveyance distance.

Further, the back tension becomes uneven due to changes in the rigidity of the film member resulting from wear of the film caused by friction with the conveyed sheet and changes in the humidity and temperature environment. Consequently, there is greater unevenness in the actual conveyance distance with respect to the ideal conveyance distance, so that such a configuration is not suited to high precision conveyance.

In addition, employing a configuration that presses a film against the sheet can cause problems such as peeling or bending of the film due to an increased load on the fixed face of the film.

SUMMARY OF THE INVENTION

One aspect of the present invention is directed to a sheet conveyance apparatus and a recording apparatus that can suppress the occurrence of sheet wrinkles and floating and can maintain high conveyance precision.

According to an aspect of the present invention, a sheet conveyance apparatus includes a conveyance roller pair that has a roller with a uniform diameter in a sheet width direction and that is configured to pinch and convey a sheet, and a guide unit that is provided on an upstream side of the conveyance roller pair and that is configured to regulate a position of an edge of the sheet, wherein the conveyance roller pair conveys the sheet in a state in which the sheet is bended by the guide unit so that on a roller side with a uniform diameter in a sheet width direction, the sheet convexly bends.

According to the exemplary embodiments described below, wrinkles and floating can be suppressed and high conveyance precision can be realized.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

A first exemplary embodiment of a recording apparatus using an inkjet system will now be described. The recording apparatus according to the present exemplary embodiment is a high-speed line printer that uses a continuous sheet wound in a roll shape, which can handle both one-sided and two-sided printing. For example, this recording apparatus is suited to fields in which a large quantity of sheets is printed, such as a print lab. The present invention can be applied in a wide range of printing apparatuses, such as a printer, a printer multifunction peripheral, a copying machine, a facsimile machine, and production apparatuses for various devices. Further, the present invention is not limited to print processing. For example, the present invention can also be applied in sheet processing apparatuses that perform various processes on a roll sheet (recording, processing, coating, irradiation, reading, inspection etc.).

Figure 1:
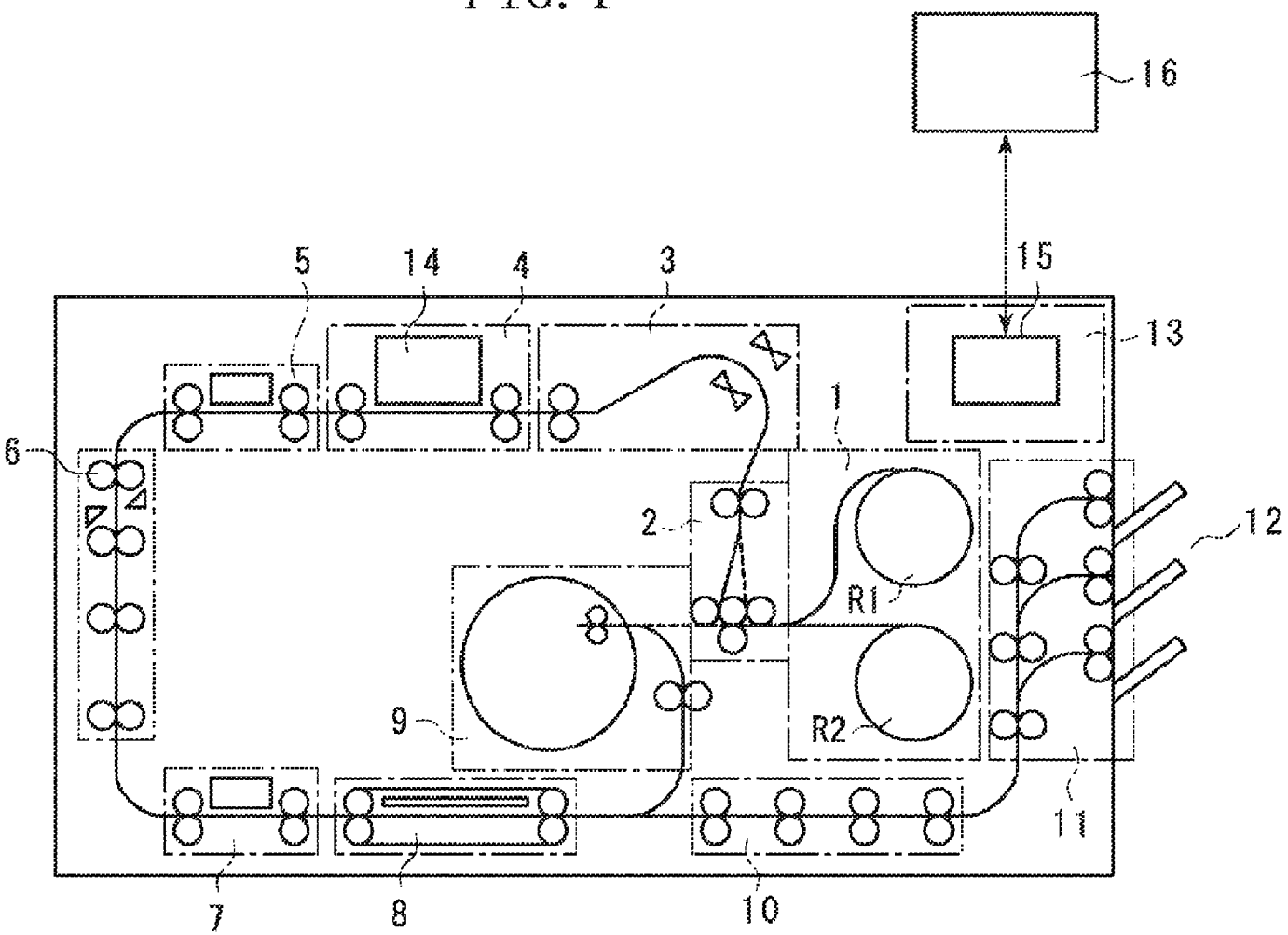
FIG. 1 is a schematic diagram illustrating an internal configuration of a recording apparatus.

FIG. 1 is a cross-sectional schematic diagram illustrating an internal configuration of a recording apparatus. The recording apparatus according to the present exemplary embodiment uses a sheet wound in a roll shape. This recording apparatus can print on both a first face and a second face (which is on the reverse side of the first face) of the sheet. The internal configuration of the recording apparatus includes a sheet feeding unit 1, a decurling unit 2, a skew correction unit 3, a printing unit 4, an inspection unit 5, a cutter unit 6, an information recording unit 7, a drying unit 8, a sheet take-up unit 9, a discharge conveyance unit 10, a sorter unit 11, a discharge tray 12, and a control unit 13. The sheet is processed by the respective units while being conveyed along a sheet conveyance path indicated by the solid line in FIG. 1 by a conveyance mechanism configured of a pair of rollers and a belt. Further, at an arbitrary position on the sheet conveyance path, the side closer to the sheet feeding unit 1 is referred to as "upstream", and the opposite side is referred to as "downstream".

The sheet feeding unit 1 stores and feeds a continuous sheet wound in a roll shape. The sheet feeding unit 1 can hold two rolls, a roll R1 and a roll R2, and can selectively draw out and feed either sheet. The number of rolls that can be stored is not limited to two, and the sheet feeding unit 1 can contain less than or greater than two rolls.

The decurling unit 2 reduces the curl (warp) of the sheet fed from the sheet feeding unit 1. The decurling unit 2 reduces curl by using two pinch rollers on one drive roller, so that when a sheet is passed through these rollers, a decurling force acts on the sheet in the opposite direction of the curl.

The skew correction unit 3 corrects the skew (tilt with respect to the original progress direction) of a sheet that has passed through the decurling unit 2. The sheet skew is corrected by pressing a sheet edge portion that serves as a reference against a guide member.

The printing unit 4 is a unit that forms an image on a conveyed sheet with a print head 14, which is a recording device. The printing unit 4 also includes a plurality of conveyance rollers that convey the sheet. The print head 14 has a line type print head in which an inkjet nozzle array is formed across a range that covers the maximum width of the sheets that will conceivably be used. The print head 14 is configured of a plurality of print heads aligned in parallel in the conveyance direction. In the present exemplary embodiment, the print head 14 has seven print heads, corresponding to the seven colors of cyan (C), magenta (M), yellow (Y), light cyan (LC), light magenta (LM), grey (G), and black (K). The number of colors and the number of print heads are not limited to seven. The inkjet method may employ a piezoelectric element, an electrostatic element, a microelectricmechanical (MEMS) device and the like. Each of the color inks is supplied to the print head 14 via a respective ink tube from an ink tank.

The inspection unit 5 determines whether an image was correctly printed by optically reading an inspection pattern or the image printed on the sheet by the printing unit 4, and inspecting the state of the nozzles in the print head, the sheet conveyance state, and the image position. The scanner has a charged-couple device (CCD) image sensor or a complementary metal-oxide-semiconductor (CMOS) image sensor.

The cutter unit 6 has a mechanical cutter that cuts a printed sheet to a predetermined length. The cutter 6 also includes a plurality of conveyance rollers for conveying the sheet to the next step.

The information recording unit 7 records print information (unique information about each image) such as a print serial number or the date on the back face of the cut sheet.

The drying unit 8 heats the sheet printed by the printing unit 4 to dry the coated ink in a short period of time. In the interior of the drying unit 8, the ink-coated surface is dried by hot air blown on the conveyed sheet from at least the bottom face side. The drying method is not limited to a blowing hot air. Drying can also be performed irradiating electromagnetic waves (e.g., UV-rays and infrared rays) on the sheet surface. The drying unit 8 also includes a conveyance belt and a conveyance roller for conveying the sheet to the next step.

The above-described sheet conveyance path from the sheet feeding unit 1 to the drying unit 8 will be referred to as a "first path". The first path has a shape which forms a U-turn between the printing unit 4 and the drying unit 8. The cutter unit 6 is positioned midway along this "U" shape.

During two-sided printing, the sheet take-up unit 9 reverses the front and back faces of the sheet by temporarily taking up the continuous sheet after printing of the front face has finished. The sheet take-up unit 9 is provided midway along a path (loop path) (referred to as "second path") that goes from the drying unit 8 to the printing unit 4 via the decurling unit 2 in order to re-feed a sheet that has passed through the drying unit 8, to the printing unit 4.

The sheet take-up unit 9 includes a take-up drum that rotates in order to take up the sheet. A continuous sheet that has finished printing on the front face (first face) but has not yet been cut is temporarily taken up onto the take-up drum. Once take-up has finished, the take-up drum is rotated in the reverse direction, so that the taken-up sheet is conveyed in the order reverse to the take-up. The sheet is fed into the decurling unit 2, and conveyed to the printing unit 4. Since the front and back faces of this sheet have been reversed, the back face (second face) can be printed by the printing unit 4. The operations performed in two-sided printing will be described in more detail below.

The discharge conveyance unit 10 conveys a sheet that has been cut by the cutter 6 and dried by the drying unit 8, and transfers the sheet to the sorter unit 11. The discharge conveyance unit 10 is provided on a path (referred to as "third path") that is different from the second path on which the sheet take-up unit 9 is provided. A path switching mechanism that has a movable flapper is provided at a path branch position to selectively guide a sheet conveyed along the first path to either the second path or the third path.

The sorter unit 11 and the discharge unit 12 are provided at a side portion of the sheet feeding unit 1 and at the end of the third path. The sorter unit 11 sorts sheets that have been printed into groups as necessary, and discharges each group of sheets into a different tray in the discharge tray 12. The sorted sheets are discharged to the discharge tray 12, which is configured of a plurality of trays. Thus, the third path has a layout in which a sheet passes below the sheet feeding unit 1, and is discharged on the side opposite the printing unit 4 and the drying unit 8 sandwiching the sheet feeding unit 1.

The control unit 13 controls each unit in the whole recording apparatus. The control unit 13 has a central processing unit (CPU), a memory, various input/output (I/O) interfaces, various sub-controllers, and a power source. Operation of the recording apparatus is controlled based on commands from the control unit 13 or a host apparatus 16, such as a host computer, that is connected to the control unit 13 via the I/O interface.

Figure 2:
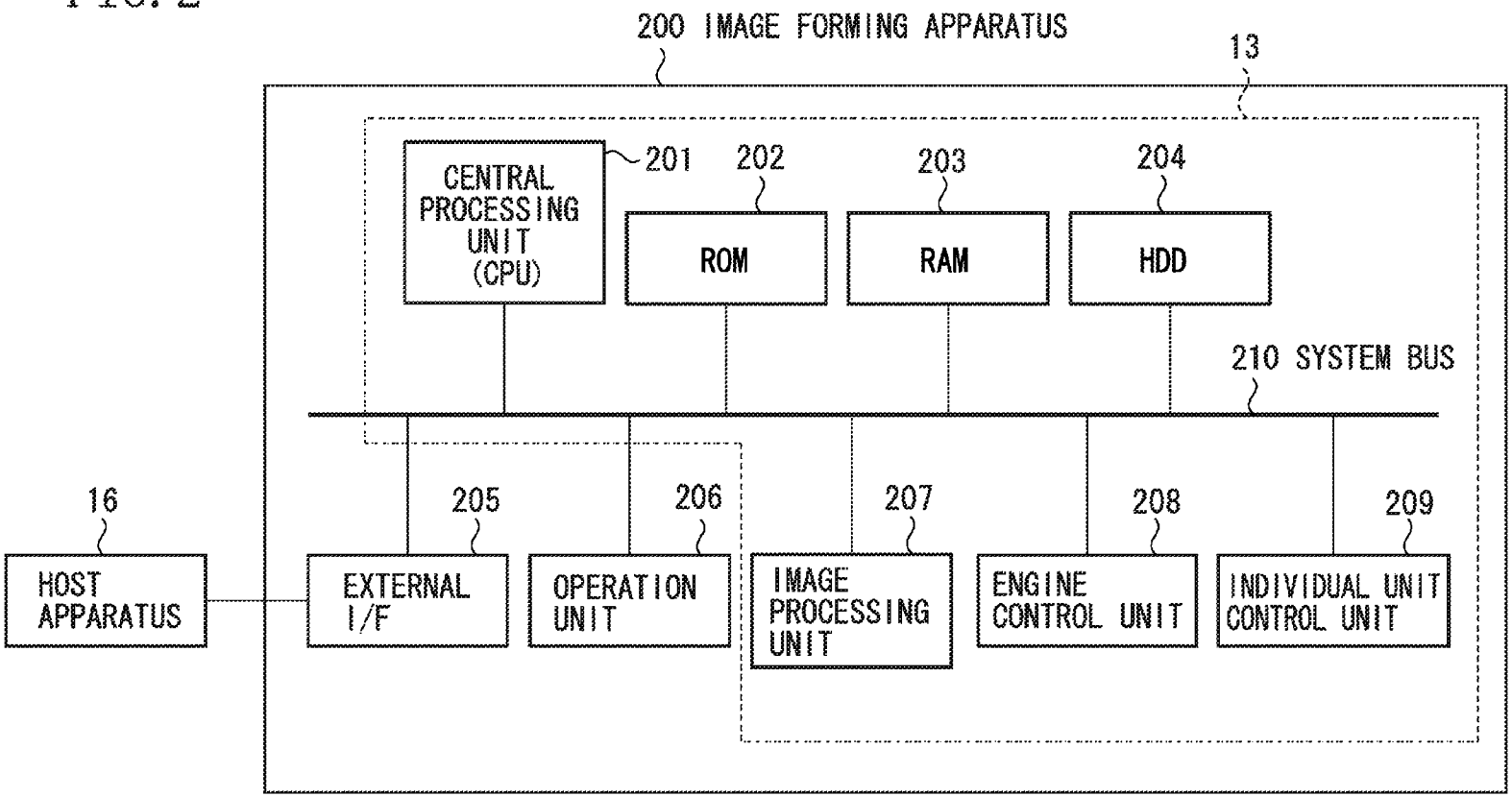
FIG. 2 is a block diagram illustrating an outline of a control unit.

FIG. 2 is a block diagram illustrating the outline of the control unit 13. The controller included in the control unit 13 (area enclosed by the dashed line) is configured of a CPU 201, a read-only memory (ROM) 202, a random access memory (RAM) 203, a hard disk drive (HDD) 204, an image processing unit 207, an engine control unit 208, and an individual unit control unit 209. The CPU 201 controls the operation of the respective units in the printing apparatus in an integrated manner. The ROM 202 stores programs to be executed by the CPU 201 and the fixed data required for the various operations of the printing apparatus. The RAM 203 is used as a work area for the CPU 201 and as a temporary storage area for various kinds of received data. The RAM 203 also stores various setting data. The HDD 204 can store and read programs to be executed by the CPU 201, print data, and the setting information required for the various operations performed by the printing apparatus. The operation unit 15 is an input/output interface with the user. The operation unit 15 includes a hard key or a touch panel input unit and an output unit, such as a display for presenting information or an audio generator.

A dedicated processing unit is provided for units for which high-speed data processing is required. The image processing unit 207 performs image processing on the print data handled by the printing apparatus. A color space (e.g., YCbCr) of the input image data is converted into a standard RGB color space (e.g., sRGB). Further, the image data is subjected as necessary to various image processing, such as resolution conversion, image analysis, and image correction. The print data obtained from these image processes is stored in the RAM 203 or the HDD 204. The engine control unit 208 performs drive control on the print head 14 in the printing unit 4 according to the print data based on a control command received from the CPU 201, for example. The engine control unit 208 also controls the conveyance mechanism of the respective units in the printing apparatus. The individual unit control unit 209 is a sub-controller for individually controlling the sheet feeding unit 1, the decurling unit 2, the skew correction unit 3, the inspection unit 5, the cutter unit 6, the information recording unit 7, the drying unit 8, the sheet take-up unit 9, the discharge conveyance unit 10, the sorter unit 11, and the discharge unit 12. Operation of the respective units is controlled by the individual unit control unit 209 based on a command from the CPU 201. The external interface (I/F) 205 connects the controller to the host apparatus 16. The external I/F 205 may be a local I/F or a network I/F. The above constituent elements are connected by a system bus 210.

The host apparatus 16 serves as the supply source of the image data to be printed by the printing apparatus. The host apparatus 16 may be a versatile or a dedicated computer, or may be a dedicated image device such as an image capture device having an image reading unit, a digital camera, and a photo storage device. If the host apparatus 16 is a computer, the computer includes a storage device in which an operating system (OS), application software for generating image data, and a printer driver for the printing apparatus are installed. Not all of the above-described processing has to be realized by software. A part or all of the processing may be realized by hardware.

Next, the basic operations performed during printing will be described. Since the operations are different for a one-sided printing mode and a two-sided printing mode, each of these modes will be described.

Figure 3:
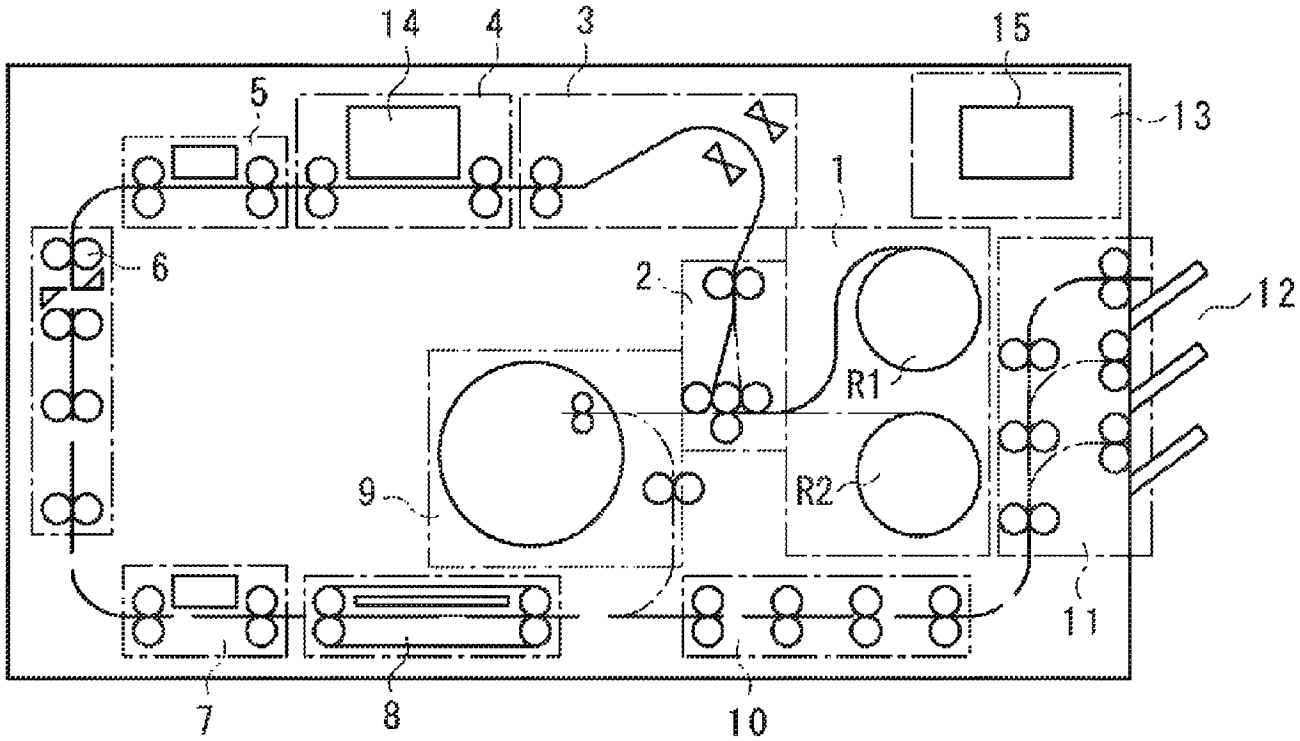
FIG. 3 illustrates operations performed during one-sided printing.

FIG. 3 illustrates the operations performed during one-sided printing. A sheet conveyance path of a sheet fed from the sheet feeding unit, 1 from printing until discharge onto the discharge tray 12 is indicated by the solid line. Printing is performed by the printing unit 4 on the front face (first face) of a sheet that has been fed from the sheet feeding unit 1 and processed by both the decurling unit 2 and the skew correction unit 3. For a long continuous sheet, a plurality of images are formed in a line by sequentially printing an image (unit image) having a predetermined unit length in the conveyance direction. The printed sheet passes through the inspection unit 5, and is cut into respective unit images by the cutter unit 6. Print information is recorded as necessary on the back face of the cut sheets by the information recording unit 7. The cut sheets are conveyed one by one to the drying unit 8 and dried. Then, the sheets pass through the discharge conveyance unit 10 and are sequentially discharged and stacked on the tray 12 in the sorter unit 11. On the other hand, the sheet remaining on the printing unit 4 side after cutting of the final unit image is fed back to the sheet feeding unit 1, and taken up by the roll R1 or R2.

Thus, for one-sided printing, the sheet is processed by passing through the first path and the third path. The sheet does not pass through the second path. To summarize the above processing, in one-sided printing a sequence consisting of the following six steps (1) to (6) is executed based on control by the control unit 13.

(1) Convey the sheet from the sheet feeding unit 1 and feed it to the printing unit 4.
(2) Repeat the unit image printing with the printing unit 4 on the first face of the fed sheet.
(3) Repeat the cutting of the sheet with the cuter unit 6 for each unit image printed on the first face.
(4) Pass the sheets cut into respective unit images one by one through the drying unit 8.
(5) Discharge the sheets that have passed through the drying unit 8 one by one to the discharge tray 12 via the third path.
(6) Cut the final unit image, and feed back the sheets remaining on the printing unit 4 side to the sheet feeding unit 1.

Figure 4:
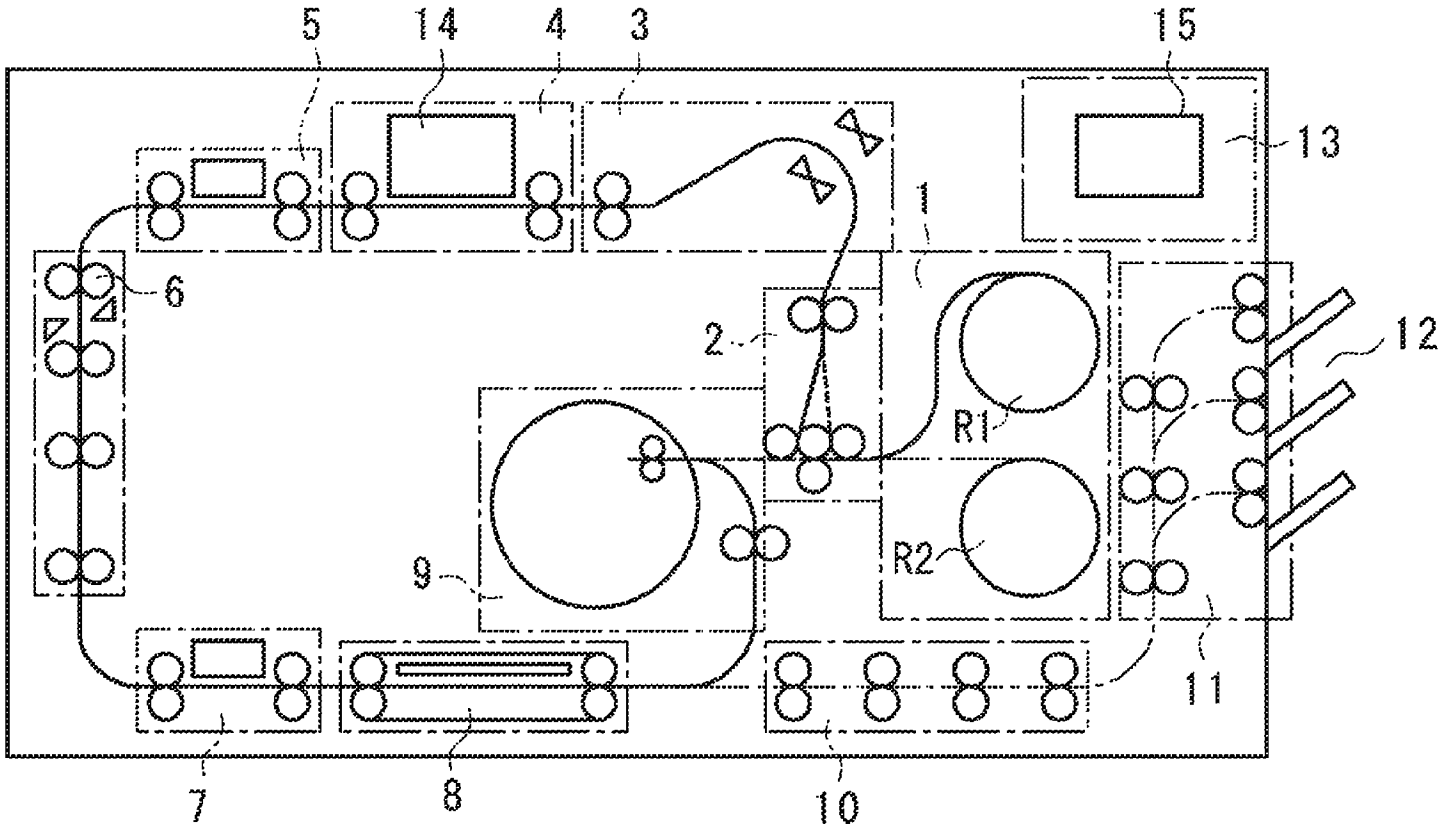
FIG. 4 illustrates operations performed during two-sided printing.

FIG. 4 illustrates operations performed during two-sided printing. For two-sided printing, a back face printing sequence is executed after the front face printing sequence. In the initial front face printing sequence, the operations from the sheet feeding unit 1 to the inspection unit 5 are the same as those for the above-described one-sided printing. The continuous sheet is conveyed as is to the drying unit 8 without performing a cutting operation at the cutter unit 6. After the ink on the front face is dried by the drying unit 8, the sheet is introduced onto the path on the sheet take-up unit 9 side (second path) instead of the path on the discharge conveyance unit 10 side (third path). The leading edge of the sheet introduced onto the second path is pinched by a roller pair 9*b* arranged on a take-up drum 9*a* in the sheet take-up unit 9.

With the leading edge of the sheet pinched by the roller pair 9*b*, the take-up drum 9*a* is rotated in a forward direction (anticlockwise direction in FIG. 4), so that the sheet is taken-up onto the take-up drum 9*a*. At the printing unit 4, when the scheduled front face printing is all finished, the trailing edge of the print region of the continuous sheet is cut by the cutter unit 6. Based on the cut position, the continuous sheet on a downstream side (printed side) in the conveyance direction passes through the drying unit 8, and all of the continuous sheet up to its trailing edge (cut position) is taken up by the sheet take-up unit 9.

On the other hand, the continuous sheet that is further upstream in the conveyance direction than the cut position is fed back to the sheet feeding unit 1 and taken up by the roll R1 or R2 so that the sheet leading edge (cut position) does not remain in the decurling unit 2. Due to this sheet take-up operation, a collision with the sheet that is re-fed in the following back face printing sequence is avoided.

After the above front face printing sequence, the processing switches to the back face printing sequence. The take-up drum in the sheet take-up unit 9 rotates in the reverse direction (clockwise direction in FIG. 4) to the take-up rotation. The edge of the taken-up sheet (the sheet trailing edge during take-up becomes the sheet leading edge during feeding) is fed along the path indicated by the dashed line in FIG. 1 to the decurling unit 2. The curl imparted by the take-up rotating body is corrected by the decurling unit 2. More specifically, the decurling unit 2 is a common unit that is provided between the sheet feeding unit 1 and the printing unit 4 in the first path and between the sheet take-up unit 9 and the printing unit 4 in the second path, which performs a decurling action on either path.

At the decurling unit 2, simultaneously with the curl correction in the direction opposite to the front face printing sequence, the front and back faces of the sheet are reversed along the conveyance path in the decurling unit. Then, the sheet passes through the skew correction unit 3, and printing is performed on the back face by the printing unit 4. The printed sheet passes through the inspection unit 5, and is cut by the cutter unit 6 into respective unit images. As a result, cut sheets (printed products) having a unit image recorded on the front and back are produced. Since the cut sheets have been printed on both sides, recording is not performed by the information recording unit 7. The cut sheets are conveyed one by one to the drying unit 8, pass through the discharge conveyance unit 10, and are sequentially discharged and stacked in the discharge tray 12 of the sorter unit 11.

Thus, in two-sided printing, a sheet is processed by passing through, in order, the first path, the second path, the first path, and the third path. To summarize the above processing, in two-sided printing a sequence consisting of the following eleven steps (1) to (11) is executed based on control by the control unit 13.

(1) Convey the sheet from the sheet feeding unit 1 and feed it to the printing unit 4.
(2) Repeat the unit image printing with the printing unit 4 on the first face of the fed sheet.
(3) Pass the sheet printed on the first face through the drying unit 8.
(4) Guide the sheet that has passed through the drying unit 8 to the second path, and take-up the sheet on the take-up drum in the sheet take-up unit 9.
(5) Cut the sheet with the cutter unit 6 behind the finally-printed unit image once repeat printing on the first face has finished.
(6) Take-up the sheet on the take-up drum until the trailing edge of the cut sheet has passed through the drying unit 8 and reached the take-up drum. In addition, cut and feed the sheet remaining on the printing unit 4 side back to the sheet feeding unit 1.
(7) When take-up is finished, rotate the take-up drum in the reverse direction, and again feed the sheet from the second path to the printing unit 4.
(8) Repeat the unit image printing with the printing unit 4 on the second face of the sheet fed from the second path.
(9) Repeat the cutting of the sheet with the cuter unit 6 for each unit image printed on the second face.
(10) Pass the sheets cut into respective unit images one by one through the drying unit 8.
(11) Discharge the sheets that have passed through the drying unit 8 one by one to the discharge tray 12 via the third path.

Figure 5:
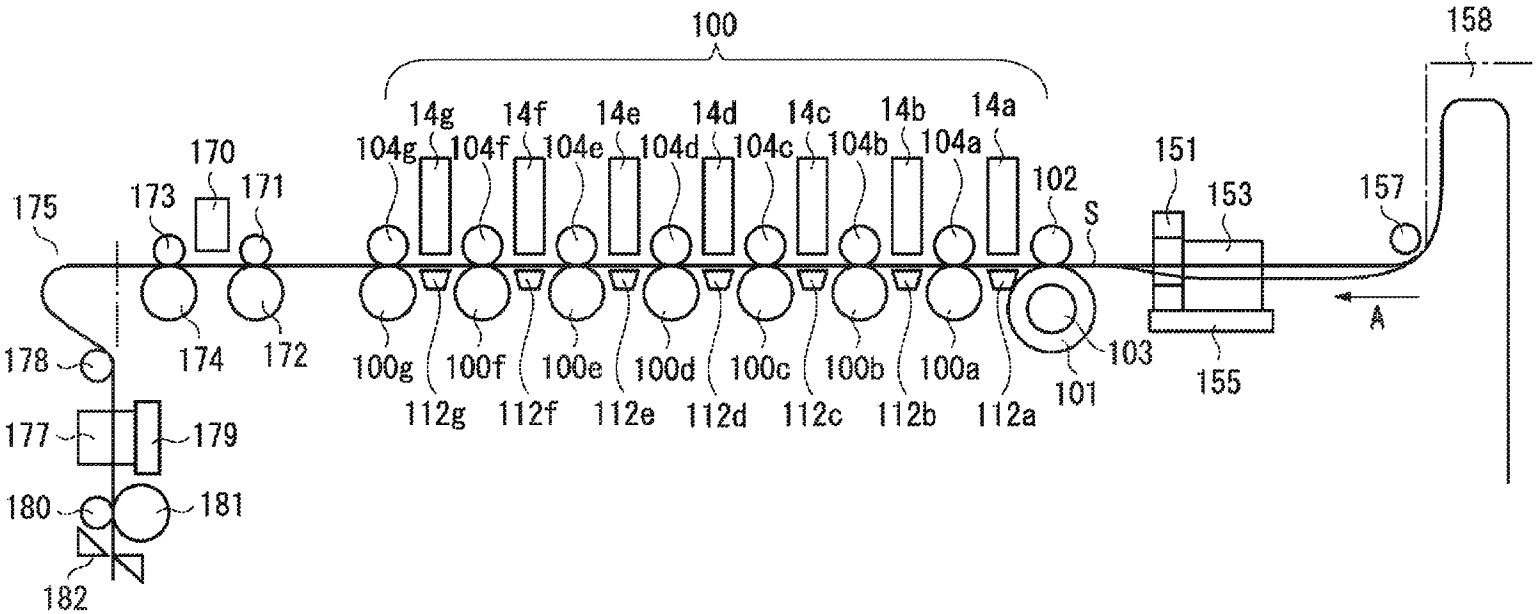
FIG. 5 is a cross-sectional diagram illustrating a skew correction unit and a printing unit.
Figure 6:
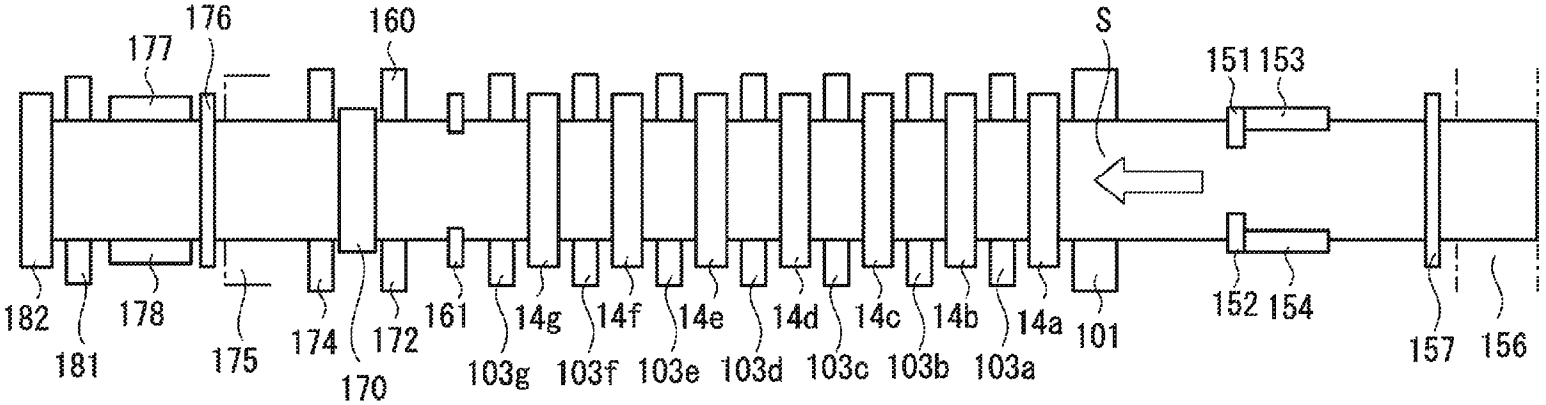
FIG. 6 is a top view illustrating a skew correction unit and a printing unit.

Next, the skew correction unit 3 and the printing unit 4 in the above-configured printer will be described in more detail. FIG. 5 and FIG. 6 are configurations of the skew correction unit 3 and the printing unit 4. In the printing unit 4, a sheet S is conveyed in the direction of arrow A in FIGS. 5 and 6 by two types of roller pair, the first roller pair and a second roller pair. The first roller pair is configured of a first conveyance roller 101 that has a drive force, and a first pinch roller 102 that is driven and rotated by the first conveyance roller 101. The first conveyance roller 101 has a uniform diameter in the sheet width direction. The first pinch roller 102 is perpendicularly split into four in the sheet conveyance direction.

Each pinch roller is configured so as to produce a pressing force in the conveyance roller direction by a (not illustrated) spring. By setting an appropriate pressing force for each pinch roller, a good conveyance precision in the printing unit is ensured. Further, each pinch roller can vary the pressure based on the type of sheet that is conveyed and the sheet width.

The term second roller pair refers to individual roller pairs (7 pairs) configured of a plurality of second conveyance rollers 103*a* to 103*g* that have a drive force, and a plurality of second pinch rollers 104*a* to 104*g* that are driven and rotated by the second conveyance rollers. The pinch roller pressing force of the first roller pair is set so that it can vary from about 6 to 14 kgf (58.8 to 137.3 N) in total. The pinch roller pressing force of the second roller pair is set to about, respectively, 300 gf (2.94 N).

Seven line-type print heads 14*a* to 14*g* corresponding to the respective colors are arranged downstream from the first roller pair in the sheet conveyance direction in a print region 100. The line-type print heads 14*a* to 14*g* and sub-pinch rollers 104*a* to 104*g* on the downstream side are alternately arranged one by one. Platens 112*a* to 112*g* are respectively arranged at a position opposite each of the print heads 114*a* to 114*g* so that when the leading edge of the sheet S passes through the print heads 114*a* to 114*g*, the sheet S is guided to the second roller pair. Since the sheet S is nipped on both sides by the roller pair at each position opposite to the print heads 114*a* to 114*g*, the sheet conveyance behavior is stable. Especially, when the sheet is first introduced, because the sheet leading edge passes through a plurality of nip positions over a short period, floating of the sheet leading edge is suppressed, so that the sheet is introduced in a stable manner.

The configurations illustrated in FIGS. 5 and 6 include an upstream side loop conveyance unit 156 and a loop guide 157 for controlling the loop shape. A pair of sheet orientation retention guides 153 and 154 is arranged close to the loop unit 156, on the downstream side. Further, sheet edge sensors 151 and 152 for detecting an edge position of the sheet are arranged close to the guides 153 and 154, on the downstream side.

Figure 7:
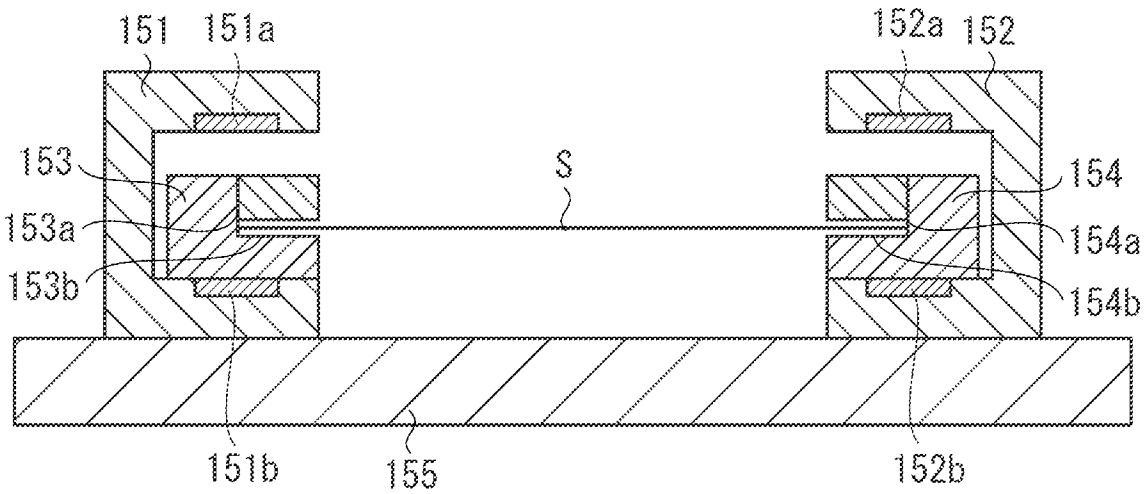
FIG. 7 illustrates a sheet orientation retention guide unit in detail.

FIG. 7 illustrates the configuration of the sheet orientation retention guides in detail. The sheet orientation retention guides 153 and 154 are a guide unit that abuts the sheet side edges to regulate the position of the sheet short side section. The sheet orientation retention guides 153 and 154 include abutting faces 153*a* and 154*a* that abut the sheet side edges to hold the sheet bended into an arch shape in the direction perpendicular to the conveyance direction. These guides enable both skew correction and prevention of wrinkles by conveying the sheet downstream in a flat shape. Further, the sheet orientation retention guides 153 and 154 also include guide faces 153*b* and 154*b* for guiding the bottom face of the sheet.

The sheet edge sensors 151 and 152 are transmission type position detection sensors that use infrared light. Infrared light is emitted from light-emitting units 151*b* and 152*b*. Light receiving units 151*a* and 152*a* detect a sheet edge position based on the amount of received light. A movement actuator 155 moves the sheet edge sensors 151 and 152 and the sheet orientation retention guides 153 and 154 in the sheet width direction. A movable sheet correction retention guide is configured of a (not illustrated) lead screw and a drive motor. The sheet orientation retention guide 153 and the sheet edge sensor 151 are integrally fixed, and can be moved integrally together to an arbitrary position by the first movement actuator 155.

The sheet edge abutting face 153*a* of the sheet orientation retention guide 153 and the sensor units 151*a* and 151*b* of the sheet edge sensor 151 are assembled without almost any error in the distance between them by measuring the position of each of these parts and adjusting as necessary. The sheet orientation retention guide 154 and the sheet edge sensor 152 on the opposite side edge of the sheet are similarly configured. The sheet edge abutting faces 153*a* and 154*a* of the sheet orientation retention guides are assembled while adjusting so that they are orthogonal to the pair of first conveyance rollers 101 and 102.

The pair of first conveyance rollers 101 and 102 possesses the greatest sheet conveyance force, and thus has the predominant influence on conveyance precision. Therefore, high precision conveyance can be easily achieved without performing excessively large skew correction in the conveyance direction by adjusting the squareness of the sheet orientation retention guides.

Further, the sheet orientation retention guides 153 and 154 bend the sheet in an arch shape in the direction perpendicular to the conveyance direction so that on a side of the first conveyance roller 101 driving upstream of the pair of first conveyance rollers 101 and 102, the sheet convexly bends. In this manner, wrinkles in the sheet caused by the sheet curling and slipping between the split rollers in the first pinch roller 102, and floating of the sheet over to the print head 14*a* to 14*g* side are prevented.

The configurations illustrated in FIGS. 5 and 6 include a scanner 170. Scanner rollers 172 and 174 perform sheet conveyance before and after the scanner. Pinch rollers 171 and 173 press the sheet down. A downstream loop unit 175 is arranged between the scanner 170 and a cutter 182, and a second loop guide 176 controls the loop shape. A second movement actuator 179 moves downstream side skew correction guides 177 and 178 to an arbitrary position in the sheet width direction. A pre-cutter conveyance roller 181 is arranged downstream from the downstream side skew correction guides. A pinch roller 180 presses down on the sheet.

Figure 8:
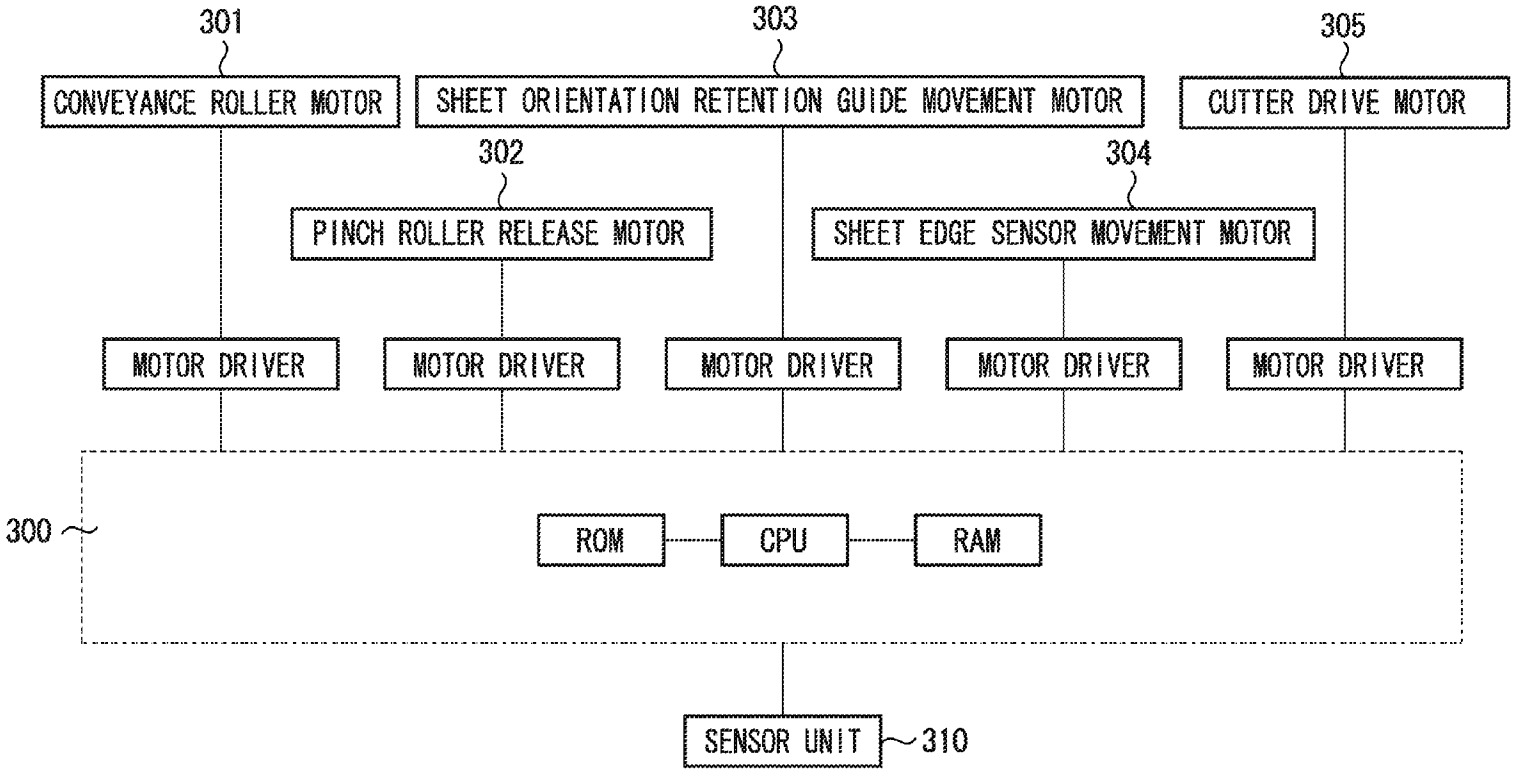
FIG. 8 illustrates a skew correction unit and a conveyance unit control unit.

FIG. 8 is a schematic diagram of the configuration of a control device that controls the printing unit 4, the cutter unit 6 and the like. This control device includes a part of the control unit 13 illustrated in FIG. 2.

A controller 300 has a ROM, a RAM, and a CPU. A sensor unit 310 is formed from a group of sensors that detect the state of the apparatus, and includes the sheet edge sensors 151 and 152. A conveyance roller motor 301 drives each conveyance roller conveying the sheet. A pinch roller release motor 302 is a contact release unit that performs a pinch roller release operation to change or release the nip pressure of the conveyance rollers. A motor 303 moves the sheet orientation retention guides. A motor 304 moves the cutter. Each of these motors is controlled by each motor driver.

The above-configured sheet conveyance operation will now be described using FIGS. 9 and 10, and the flowchart illustrated in FIG. 11. A sheet S fed from the sheet feeding unit 1 forms a loop with the loop unit 156, then passes through the sheet orientation retention guides 153 and 154, and is conveyed until it reaches the first roller pair. At this point, the first pinch roller 102 is separated from the first conveyance roller 101. In step S101, if it is determined that the sheet S has been conveyed as far as the pair of first conveyance rollers 101 and 102 (YES in step S101), the processing proceeds to step S102.

Figure 9A:
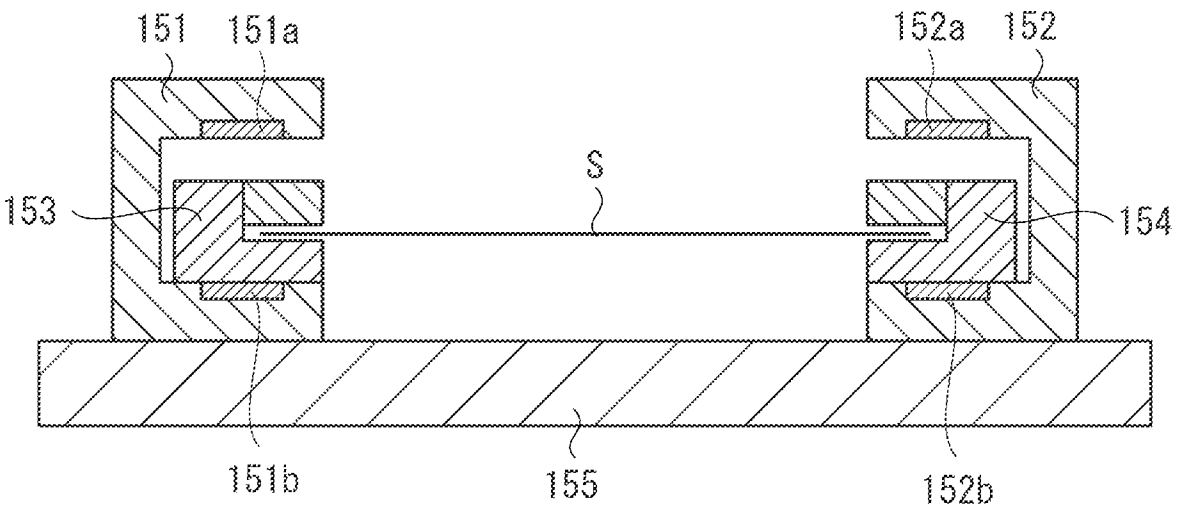
FIGS. 9A and 9B are cross-sectional diagrams illustrating operation of the sheet orientation retention guides.
Figure 10A:
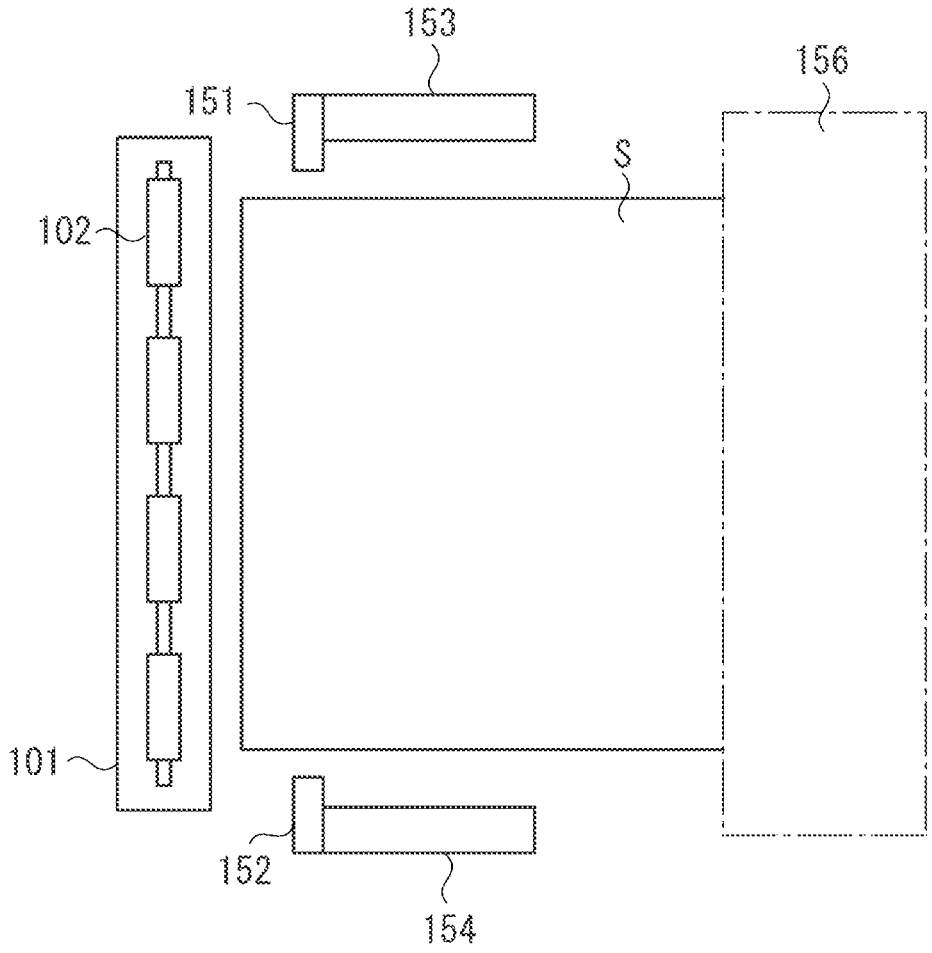
FIGS. 10A and 10B are top views illustrating operation of the sheet orientation retention guides.

In step S102, the first pinch roller 102 is moved by the pinch roller release motor 302, and the sheet is pinched by the first conveyance roller pair. The sheet orientation retention guides 153 and 154 are at first standing by at respective positions separated from the sheet edge, as illustrated in FIGS. 9A and 10A. When the sheet leading edge reaches the first roller pair, and is nipped by the first roller pair, in step S103, the sheet edge is detected by the sheet edge sensors 151 and 152. Further, in step S103, the sheet orientation retention guides 153 and 154 are moved by the sheet orientation retention guide movement motor 303 closer to the sheet. The sheet edge sensors 151 and 152 each move integrally with the sheet orientation retention guides 153 and 154. The sheet edge is detected by the light receiving units 151*a* and 152*a* based on changes in the received light amount that occur during the movement process.

Figure 9B:
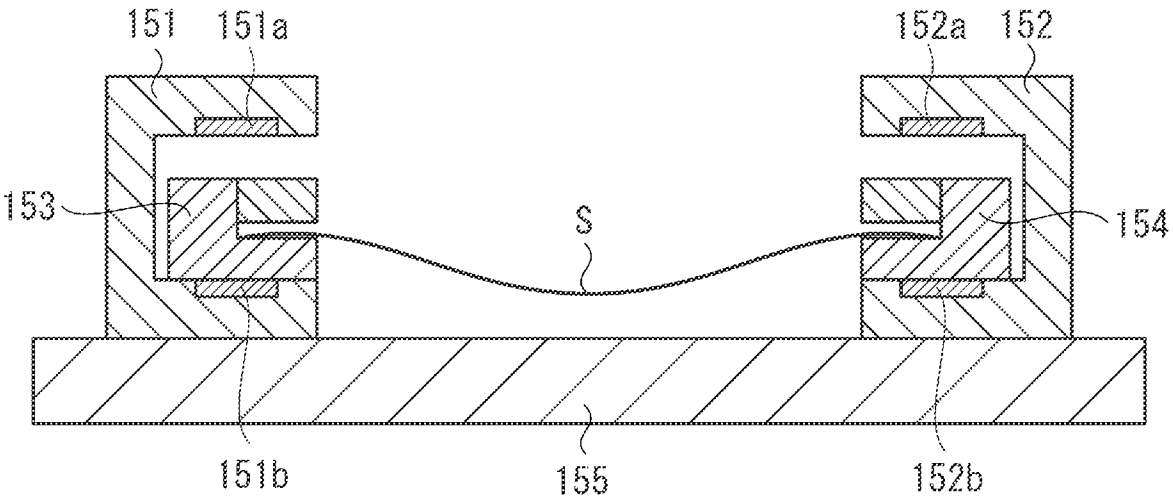
Figure 10B:
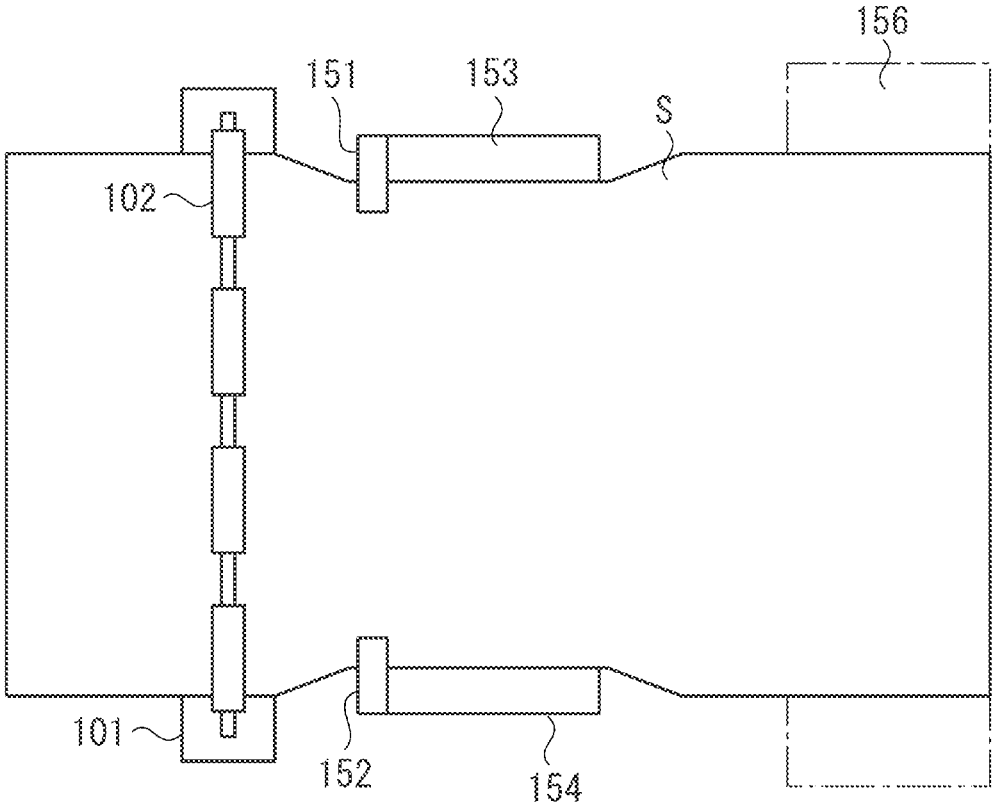
Figure 11:
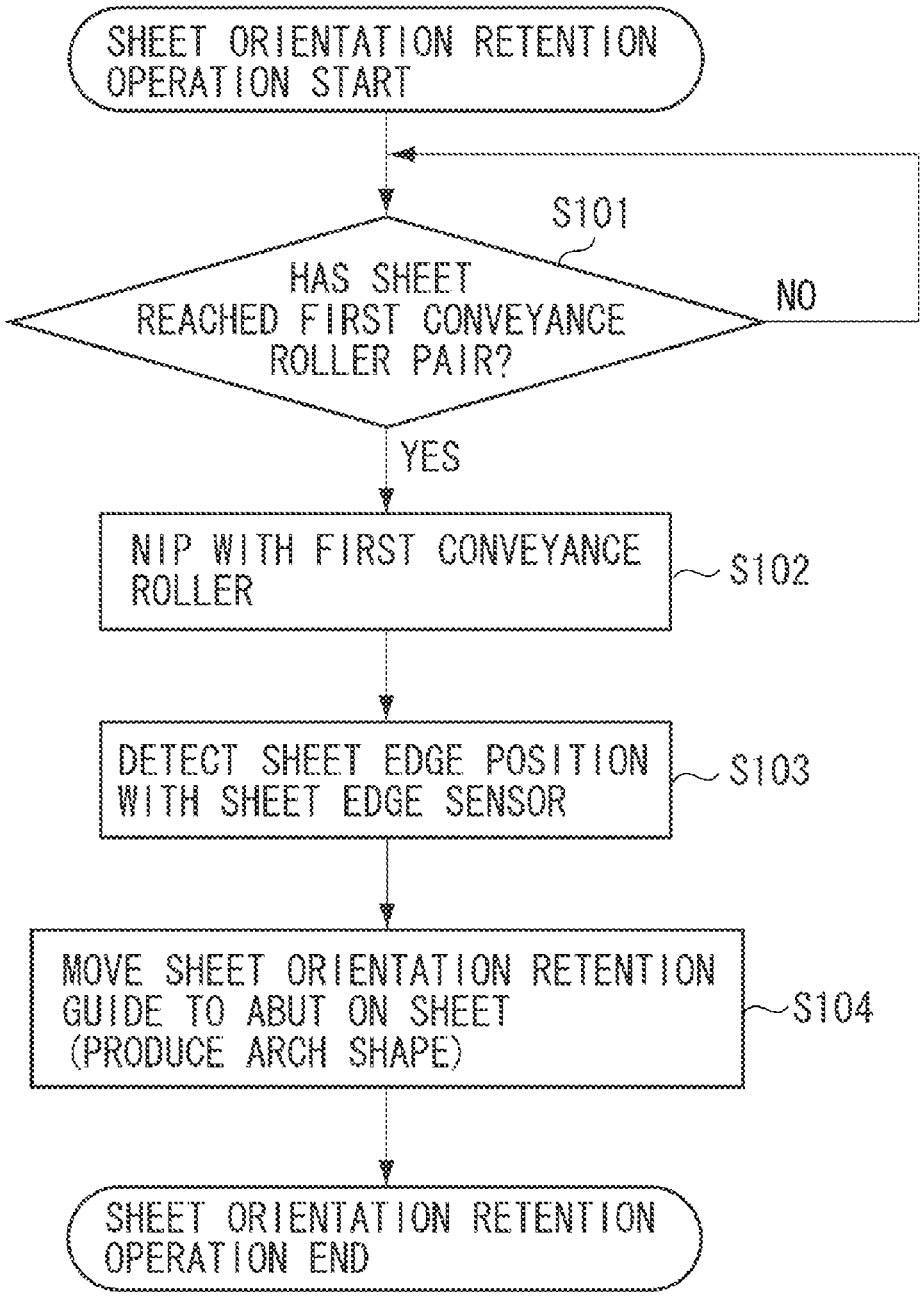
FIG. 11 is a flowchart of sheet orientation retention guide operation.

Next, in step S104, the sheet orientation retention guides are moved as illustrated in FIGS. 9B and 10B to have a narrower width than the sheet width based on the sheet edge detection result. As described above, since the sheet orientation retention guides 153 and 154 and the sheet edge sensor move integrally when adjusting the position, the position of the sheet edge and the sheet orientation retention guides can be precisely positioned with respect to the sheet. Therefore, since the sheet edge can be precisely pressed by the sheet orientation retention guides, and since the bend in the sheet constantly gives way toward the lower side under its own weight, an arch shape that has an optimum shape can be formed on the lower side (first conveyance roller 101 side). Although in an example described here, an arch shape is formed on the lower side, if it has a vertically reverse configuration, in which the first conveyance roller pair has the drive roller on an upper side and the split driven rollers on the lower side, the sheet orientation retention guides are arranged so that the arch is formed on the upper side.

Then, the sheet leading edge is conveyed by the second conveyance roller pair of the next printing unit. In order to convey the sheet edge along the orientation retention guides while opposing the force that skews the sheet, a configuration that facilitates rotation around the sheet orientation retention guides is optimal. In this configuration, a curved conveyance path is provided on the upstream side of the sheet orientation retention guides 153 and 154. In addition, the loop conveyance unit 156 is provided to convey the sheet while making the sheet curl at this conveyance path. Consequently, even if a force causing the sheet to skew acts on the sheet while the sheet is conveyed by the respective conveyance roller pairs, the sheet can be moved relatively freely in the sheet width direction in the loop conveyance unit 156, which is arranged nearby on the upstream side of the sheet orientation retention guides. Therefore, the portion of the sheet that is located further downstream can be rotated around the sheet orientation retention guides, so that the sheet can be easily conveyed along the sheet orientation retention guides. To increase the conveyance precision in the sheet conveyance direction it is effective to set the pressing force of the conveyance rollers higher than a predetermined pressure based on the sheet type and sheet size. Further, to perform skew correction, it is effective to set the pressing force of the conveyance rollers lower than a predetermined pressure based on the sheet type and sheet size.

The sheet leading edge passes through the scanner 170, to form a loop in the downstream loop unit 175, and is conveyed through the downstream skew selection guide 177 that matches the sheet width. Then, the sheet is conveyed by the pair of pre-cutter rollers 180 and 181, and is cut as necessary to a desired size by the cutter 182.

In the above exemplary embodiment, although a line-type print head is provided for each color in the printing unit 4, the present invention is not limited to this. For example, the same configuration may also be employed for a serial-type single print head. Further, the sheet orientation retention guides may be configured so that one side abutting the sheet edge is pressed toward the sheet edge by an elastic member, such as a spring. In this case, slight positioning errors of the sheet orientation retention guides with respect to the sheet shape can be absorbed depending on the sheet type. Consequently, the margin against sheet buckling is further increased.

The printing apparatus according to the above exemplary embodiment is a sheet conveyance apparatus that includes a conveyance roller pair that nips and conveys the sheet on the upstream side of the printing unit 4, and orientation retention guides that keep the orientation of the sheet uniform on the upstream side of the conveyance roller pair. The conveyance roller pair is configured of one roller that has a uniform diameter in the sheet width direction and another roller that is split in the sheet width direction. The sheet orientation retention guides are configured so that the sheet is bended into an arch shape in the direction perpendicular to the conveyance direction so that on the roller side having a uniform diameter in the sheet width direction, the sheet convexly bends.

Based on this configuration, the sheet is bended into an arch shape by the sheet orientation retention guides, and pressed toward the roller side having a uniform diameter in the sheet width direction, which prevents the sheet from curling and slipping into a gap between the rollers in the first pinch roller 102. More specifically, the sheet is nipped by the first conveyance roller 101 and the first pinch roller 102 after the bended portion protruding out from the bottom of the sheet is brought into contact with the periphery of the first conveyance roller 101 and flattened. Although the sheet bending is illustrated in an exaggerated manner in FIGS. 9B and 10B for the sake of the description, in actual fact a sufficient effect can be obtained even if the bending is slight.

Therefore, even when the orientation of the conveyed sheet is unstable, or when the sheet itself has undulations in the direction perpendicular to the conveyance direction due to moisture adsorption, for example, the sheet can be conveyed downstream without having wrinkles or floating by correcting the sheet into a flat shape. Further, since the sheet can be conveyed without using a pressing member such as a film or applying back tension on the roller pairs, high precision conveyance can be realized that is not easily affected by changes in durability or the environment.

Figure 12:
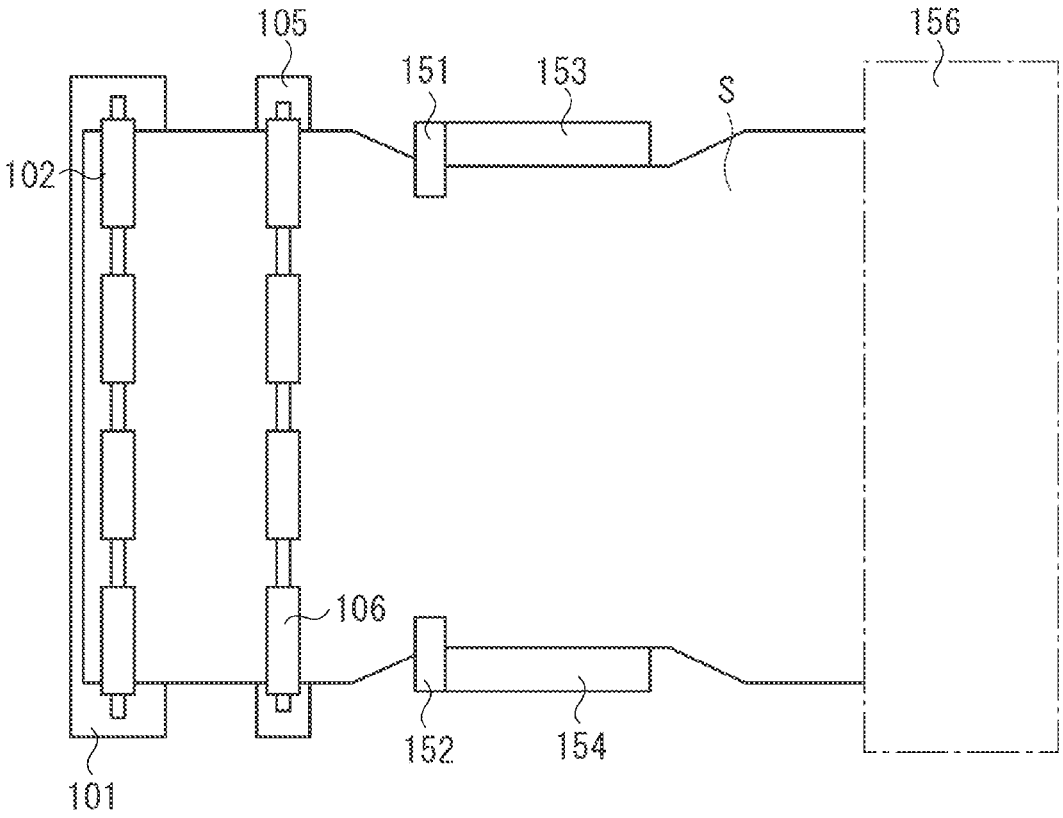
FIG. 12 is a top view illustrating sheet orientation retention guides according to a second exemplary embodiment.

FIG. 12 is a top view illustrating sheet orientation retention guides according to a second exemplary embodiment.

In the second exemplary embodiment, a third conveyance roller pair, which acts as a sub-conveyance roller pair, is arranged between the pair of first conveyance rollers 101 and 102 and the sheet orientation retention guides 153 and 154. The third conveyance roller pair is configured of a third conveyance roller 105 that is driven by a motor and a third pinch roller 106 that is driven and rotated by the third conveyance roller 105. The third conveyance roller 101 has a uniform diameter in the sheet width direction. The third pinch roller is configured so as to produce a pressing force in the third conveyance roller direction by a (not illustrated) spring. The pressing force of the third roller pair is about 9.8 N (about 1 kgf). Further, although the third pinch roller 106 illustrated in FIG. 12 is perpendicularly split in four in the sheet conveyance direction, the third pinch roller 106 may also be a roller having a uniform diameter in the sheet width direction, or may be a roller that is arbitrary split into a plurality of sections.

The sheet orientation retention guides 153 and 154 are stopped at a position where the interval between the abutting faces 153*a* and 154*a* of the sheet orientation retention guides 153 and 154 is wider than the sheet width. The first pinch roller 102 is separated from the first conveyance roller 101, and the third pinch roller 106 is separated from the third conveyance roller 105. In this state, the sheet S fed from the sheet feeding unit 1 produces a loop in the loop unit 156. Then, the sheet passes through the sheet orientation retention guides 153 and 154 and the third conveyance roller pair, and is conveyed as far as the first roller pair.

When the sheet S has been conveyed as far as the first conveyance roller pair, the sheet is pinched by the pair of first conveyance rollers 101 and 102 and the pair of third conveyance rollers 105 and 106. Then, similar to the first exemplary embodiment, the sheet orientation retention guides 153 and 154 are moved so that the interval between the abutting faces 153*a* and 154*a* of the sheet orientation retention guides 153 and 154 becomes narrower than the sheet width. At this point, since the bend in the sheet S constantly gives way toward the lower side under its own weight, an arch shape that has the optimum shape can be formed on the lower side (first conveyance roller 101 and third conveyance roller 105 side). Further, although an example of forming an arch on the lower side is described here, when the upper roller in the first roller pair is a drive roller having a uniform diameter and the lower roller is a split driven roller, and the upper roller in the third roller pair is a drive roller having a uniform diameter, the sheet orientation retention guides are arranged such that the arch is produced on the upper side.

Then, the sheet leading edge is sequentially conveyed by the second conveyance roller pair in the printing unit. Since the subsequent operations are the same as in the first exemplary embodiment, a description thereof will be omitted here.

Further, since the block diagram illustrating the control unit according to the present exemplary embodiment has the same configuration as the first exemplary embodiment, an illustration and a description thereof will be omitted here.

According to the second exemplary embodiment, the sheet S can be corrected into a flat shape by the third roller pair bending the orientation of the sheet into an arch shape in the direction perpendicular to the conveyance direction by sheet orientation retention guides arranged on an upstream side of the third roller pair, and pressing on the roller side having a uniform diameter in the sheet width direction. Consequently, the sheet S is constantly conveyed in a flat shape to the first roller pair. Therefore, even when the orientation of the sheet is unstable, or when the sheet itself has undulations in the direction perpendicular to the conveyance direction due to moisture adsorption, for example, the sheet can be conveyed downstream without having wrinkles or floating by correcting the sheet into a flat shape. Further, since the sheet can be conveyed without using a pressing member such as a film or applying back tension on the roller pair, high precision conveyance can be realized that is not easily affected by changes in durability or the environment.

In the above exemplary embodiments, the sheet edge sensors 151 and 152 detect the position of a sheet side edge, and the abutting faces 153*a* and 154*a* of the sheet orientation retention guides 153 and 154 are moved to a position that matches the actual sheet edge position. If the difference between the position of the sheet side edges detected by the sheet edge sensors 151 and 152 and the ideal sheet conveyance region is within a predetermined range, the abutting faces 153*a* and 154*a* may be moved to a position that matches the ideal sheet conveyance region.

According to the above exemplary embodiments, similar to the conventional art, a bias can be applied between split rollers so that a uniform pressing force is applied on the sheet. Consequently, the sheet can be pinched and conveyed with a suitable nip pressure without bending of the conveyance rollers. In addition, the sheet S can be prevented from slipping between the split rollers since the orientation of the sheet is bended into an arch shape in the direction perpendicular to the conveyance direction by sheet orientation retention guides arranged on the upstream side of the conveyance roller pair, and the roller side having a uniform diameter in the sheet width direction is pressed. Therefore, even when the orientation of the conveyed sheet is unstable, or when the sheet itself has undulations in the direction perpendicular to the conveyance direction due to moisture adsorption, for example, the sheet can be conveyed downstream without having wrinkles or floating by correcting the sheet into a flat shape. Further, since the sheet can be conveyed without applying back tension on the roller pair, high precision conveyance can be realized that is not easily affected by changes in durability or the environment.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-028823 filed Feb. 14, 2011, which is hereby incorporated by reference herein in its entirety.

What is claimed is:

1. A sheet conveyance apparatus comprising:

a conveying unit configured to convey a sheet in a conveying direction by rolling at least one of a first conveying roller, having a uniform diameter in a sheet width direction which crosses to the conveying direction, and a second conveying roller provided on a facing position to the first conveying roller; and a regulating unit configured to regulate a position of an edge of the sheet in the sheet width direction by moving at least one of guide members configured to guide the sheet in the sheet width direction, the guide members being provided on an upstream side of the first conveying roller in the conveying direction, wherein the conveying unit conveys the sheet in a state that the sheet is convexly bent toward a side of the first conveying roller by regulating the position of the edge of the sheet in the sheet width direction by the regulating unit.

2. The sheet conveyance apparatus according to claim 1, wherein the bend formed by the regulating unit is equalized by coming into contact with a periphery of the first conveying roller.

3. The sheet conveyance apparatus according to claim 1, wherein the second conveying roller is split in the sheet width direction.

4. The sheet conveyance apparatus according to claim 1, further comprising an actuator configured to move the guide member in a sheet width direction.

5. The sheet conveyance apparatus according to claim 1, further comprising:

a sensor configured to integrally move with the guide member and detect a sheet, wherein the regulating unit is configured to move the one of the guide members in the sheet width direction based on detection of a sheet by the sensor.

6. The sheet conveyance apparatus according to claim 1, further comprising:

a sub-conveyance roller pair having a roller with a uniform diameter in a sheet width direction arranged on an upstream side of the first conveying roller in the conveying direction.

7. The sheet conveyance apparatus according to claim 1, wherein a conveyance path on an upstream side of the guide member is curved, and wherein the sheet conveyance apparatus further comprises a loop conveyance unit configured to convey the sheet along the conveyance path while bending the sheet.

8. The sheet conveyance apparatus according to claim 1, wherein the sheet is a roll sheet wound in a roll shape, and wherein the sheet conveyance apparatus further comprises a sheet feeding unit configured to hold the roll sheet and draw out the held roll sheet.

9. The sheet conveyance apparatus:

according to claim 1, further comprising:

a recording unit configured to record an image on a sheet conveyed by the conveying unit.

10. The sheet conveyance apparatus according to claim 1, wherein the regulating unit regulates the position of the edge of the sheet in the sheet width direction by moving both of a guide member provided nearby one side of edge of the sheet in the sheet width direction and a guide member provided nearby the other side of edge of the sheet in the sheet width direction.

11. A sheet conveyance apparatus comprising:

a conveying unit configured to convey the sheet in a conveying direction by rolling at least one of a first conveying roller, having an uniform diameter in a sheet width direction which crosses to the conveying direction, the first conveying roller being provided on a position below the sheet, and a second conveying roller provided on a facing position to the first conveying roller; and a regulating unit configured to regulate a position of an edge of the sheet in the sheet width direction by moving at least one of guide members configured to guide the sheet in the sheet width direction, the guide members being provided on an upstream side of the first conveying roller in the conveying direction, wherein the conveying unit conveys the sheet in a state that the guide members are moved to a position where a length between the guide members in the sheet width direction is shorter than a length of the sheet in the sheet width direction by the regulating unit.

12. The sheet conveyance apparatus according to claim 11, further comprising:

a recording unit configured to record an image on a sheet conveyed by the conveying unit.

13. The sheet conveyance apparatus according to claim 11, wherein the regulating unit regulates the position of the edge of the sheet in the sheet width direction by moving both of a guide member provided nearby one side of edge of the sheet in the sheet width direction and a guide member provided nearby the other side of edge of the sheet in the sheet width direction.

14. The sheet conveyance apparatus according to claim 11, further comprising a sensor configured to integrally move with the guide member and detect a sheet, wherein the regulating unit is configured to move the one of the guide members in the sheet width direction based on detection of a sheet by the sensor.

15. A sheet conveyance apparatus comprising:

a conveying unit configured to convey a sheet in a conveying direction by rolling at least one of a first conveying roller provided on a position below the sheet, and a second conveying roller provided on a facing position to the first conveying roller; and a regulating unit configured to regulate a position of an edge of the sheet in a sheet width direction which crosses to the conveying direction by moving at least one of guide members configured to guide the sheet in the sheet width direction, the guide members being provided on an upstream side of the first conveying roller in the conveying direction, wherein the conveying unit conveys the sheet in a state that the guide members are moved to a position where a length between the guide members in the sheet width direction is shorter than a length of the sheet in the sheet width direction by the regulating unit.

* * * * *